United States Patent [19]

Akashi

[11] 4,267,621

[45] May 19, 1981

[54] SLIDE FASTENER

[75] Inventor: Shunji Akashi, Kurobe, Japan

[73] Assignee: Yoshida Kogyo K.K., Tokyo, Japan

[21] Appl. No.: 80,703

[22] Filed: Oct. 1, 1979

[30] Foreign Application Priority Data

Oct. 9, 1978 [JP] Japan ..... 53-138712[U]

[51] Int. Cl.[3] ..... A44B 19/36

[52] U.S. Cl. ..... 24/205.11 R; 24/205.11 F

[58] Field of Search ..... 24/205.11 R, 205.11 F

[56] References Cited

U.S. PATENT DOCUMENTS

| | | | |
|---|---|---|---|
| 2,220,136 | 11/1940 | Marinsky | 24/205.11 F |
| 3,748,709 | 7/1973 | Potin | 24/34 |
| 3,905,075 | 9/1975 | Fukuroi | 24/205.11 F X |
| 3,906,594 | 9/1975 | Takahashi | 24/205.11 F |
| 3,969,794 | 7/1976 | Ebata | 24/205.11 F |
| 3,972,095 | 8/1976 | Kandou | 24/205.11 F |
| 4,123,827 | 11/1978 | Yoshida | 24/205.11 F X |
| 4,155,147 | 5/1979 | Akashi | 24/205.11 F |

FOREIGN PATENT DOCUMENTS

| | | | |
|---|---|---|---|
| 1,474,052 | 5/1977 | Britain | 24/205.11R |

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

A slide fastener is provided with an end stop made of a synthetic-resinous strip and comprising a platelike body substantially rectangular in plan. The strip is thermally molded on longitudinally of a plurality of fastener elements so as to extend over substantially the entire width of a row of fastener elements. An elongated ridge portion is provided longitudinally of the platelike body so as to register with respective lines of sewn stitches.

4 Claims, 9 Drawing Figures

SLIDE FASTENER

BACKGROUND OF THE INVENTION

1. Field of the Invention

This invention relates to improvements in slide fastener of the type comprising a pair of carrier tapes having sewn along their inner longitudinal edges the respective rows of continuous interlocking fastener elements—either of the coil type or of the meandering type—made of a synthetic-resinous material, and more particularly to end stops—either top stops or bottom stops whichever the case may be—of the type comprising a strip of synthetic-resinous material molded on either end of the rows of fastener elements of the slide fastener of the type as above described and adapted to block displacement of a slider therebeyond in a fastener-opening and/or fastener-closing direction.

2. Description of the Prior Art

There have been heretobefore proposed end stops of the type in which a synthetic-resinous strip is molded on a plurality of fastener elements at either end of the rows of fastener elements by means of ultrasonic processing to form an end stop thereat. As is well known in this art, it is a common practice that the rows of continuous fastener elements are attached to the carrier tapes with lines of sewn stitches binding the arm portion of the former to the latter. This means that the lines of sewn stitches are partly exposed on those arm portions to ultrasonic energy generated by an ultrasonic horn during the end-stop-molding operation. As a result of undergoing the ultrasonic energy, the lines of sewn stitches become rather feeble or are liable to break, which would lead to displacement of the end stop off the fastener elements, or, even if it is not that bad, to positional and postual instability of the fastener elements relative to the carrier tapes, thereby extremely impairing the function of the end stop as such.

SUMMARY OF THE INVENTION

With the foregoing drawbacks of the prior art in view, it is a primary object of this invention to provide a slide fastener having an improved end stop comprising a synthetic-resinous strip thermally molded on either end of rows of fastener elements by means of an ultrasonic horn and structured to forbid the ultrasonic energy generated thereby to adversely affect and make feeble lines of sewn stitches binding those fastener elements where to mold the synthetic-resinous strip to the carrier tapes.

The second object of this invention is to provide a slide fastener having an improved end stop structured to help close the slide fastener closely or tightly with very little looseness.

The third object of this invention is to provide a slide fastener having an improved end stop structured to be retained to the slide fastener in stabler and firmer manner.

With these and other objects in view, this invention is directed to a slide fastener comprising: (a) a pair of carrier tapes; (b) two rows of continuous interlocking fastener elements made of a synthetic-resinous material and secured by lines of sewn stitches to inner edges of said respective tapes; (c) a slider including a slider body, a pair of side flanges provided on the opposite side edges there-of and a neck portion provided on the flared front end of said slider body to define with said slider body and said side flanges a Y-shaped channel to slidably receive said interlocking fastener elements for opening and closing thereof; and (d) a top stop made of a synthetic-resionous material and comprising a platelike body substantially rectangular in plan molded on and longitudinally of a plurality of uppermost fastener elements of one of said rows of fastener elements so as to extend over the substantially entire width of said one row of fastener elements and an elongated ridge portion provided on and longitudinally of said platelike body so as to extend along its linear region registering with one of said lines of sewn stitches. Furthermore, the invention is directed to a slide fastener comprising: (a) a pair of carrier tapes; (b) two rows of continuous interlocking fastener elements made of a synthetic-resinous material and secured by lines of sewn stitches to inner edges of said respective tapes; (c) a slider including a slider body, a pair of side flanges provided on the opposite side edges thereof and a neck portion provided on the flared front end of said slider body to define with said slider body and said side flanges a Y-shaped channel to slidably receive said interlocking fastener elements for opening and closing thereof; and (d) a bottom stop made of a synthetic-resinous material and comprising a platelike body rectangular in plan molded on and longitudinally of a plurality of lowermost interlocked fastener elements of said two rows of fastener elements so as to extend over the substantially entire width of said two interlocked rows of fastener elements and two ridge portions provided on and longitudinally of said platelike body so as to extend along its linear regions registering with the respective lines of sewn stitches.

Other objects, advantages and features of the invention will become apparent from the following description of the preferred embodiments taken in conjunction with the accompanying drawings.

DESCRIPTION OF THE PREFERRED EMBODIMENT

Figure 1:
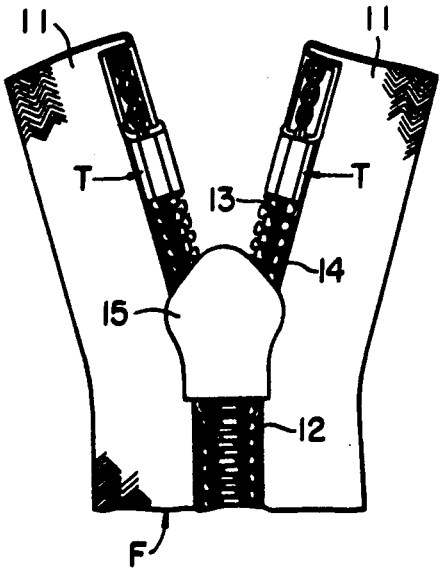
FIG. 1 is a fragmentary rear view of the concealed type of slide fastener incorporating a preferred form of top stop members according to this invention.
Figure 2:
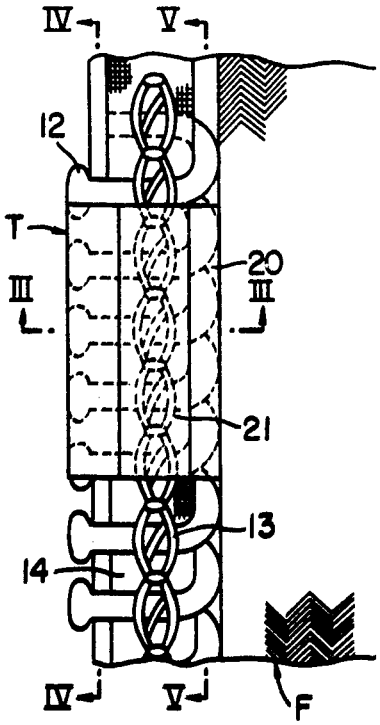
FIG. 2 is an enlarged rear view of one of the two stringers constituting the slide fastener of FIG. 1 incorporating one of the top stop members.
Figure 3:
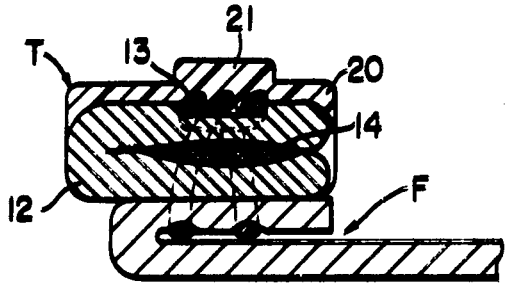
FIG. 3 is an enlarged cross-sectional view of the stringer of FIG. 2 as taken along the plane of the line III—III in FIG. 2.

FIGS. 1, 2 and 3 illustrate a slide fastener F of the concealed type produced according to this invention which slide fastener comprises a pair of carrier tapes 11, 11 each having an inner longitudinal edge folded rearwardly on itself, two rows of interlocking fastener elements 12, 12 sewn by lines of sewn stitches 13, 13 to and along the respective longitudinal folded edges through the agency of the respective filling cores 14, 14 inserted through the rows of interlocking fastener elements 12, 12, and a slider 15 slidably mounted on and along the rows of interlocking fastener elements 12, 12 for coupling and decoupling thereof and hence for opening and closing the slide fastener F. Although the invention is now shown as embodied in the concealed type of slide fastener, it may likewise apply to a slide fastener of the ordinary type, of course. The fastener elements 12, 12 are formed in a continuous filament such as spiral coils, as illustrated here in the drawings, or meanders of continuous filament formed in such a manner to produce interlocking fastener elements 12 as is well know in the art. As better seen in FIGS. 6 and 7, the slider 15 comprises a slider body 16, a pair of side flanges 17, 17 provided on and along the opposite sides of the slider body 16 and a neck portion 18 centrally of the flared front end of the slider body 16 to define with the slider body 16 and the side flanges 17, 17 a Y-shaped channel, through which the rows of fastener elements 12, 12 are permitted to slidably reciprocate for the opening and closing operation of the slide fastener F.

Figure 6:
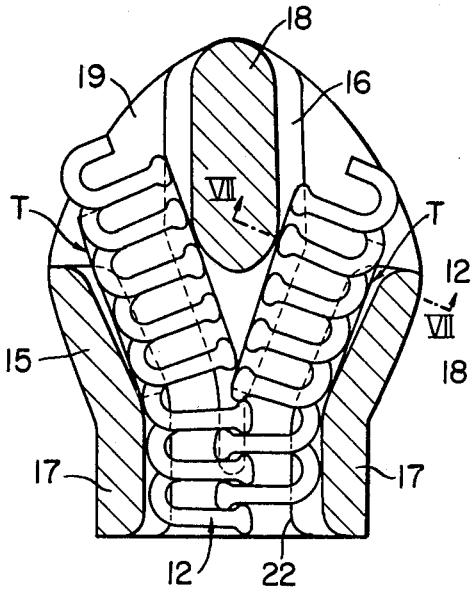
FIG. 6 is a horizontal sectional view of the slide fastener of FIG. 1 with its filling cores and carrier tapes omitted for clarity's sake, showing how both the top stop members assume their operative positions in the slider to lock it on the rows of interlocking fastener elements.
Figure 7:
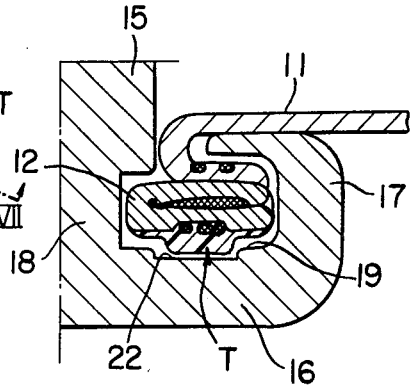
FIG. 7 is a cross-sectional view of a right half of the slide fastener of FIG. 6 as taken along the plane of VII—VII in FIG. 6.

In accordance with the novel concepts of this invention, there is provided a top stop comprising a pair of top stop members T, T for limiting the upward or fastener closing movement of the slider 15 along the rows of fastener elements 12, 12. These top stop members T, T are made of a suitable synthetic-resinous material such as for example a nylon or a polyester and molded on the fastener elements 12, 12 by usual technique of thermal fusion such as ultrasonic processing. Each of the top stop members T, T is substantially rectangular in plan and comprises a platelike body 20 molded on and longitudinally of several uppermost fastener elements 12, 12 of one of the rows of fastener elements and an elongated ridge portion 21 provided on the platelike body 20 so as to extend throughout the full length thereof. The platelike body 20 extends over the entire width of the single row of fastener elements 12, while the ridge portion 21 extends on and along that linear region of the platelike body 20 which registers with the line of sewn stitches 13. In the slider body 16 on its inner surface partly defining the fastener-element-receiving Y-shaped channel, as shown in FIGS. 6 and 7, is provided a Y-shaped guide groove 22 so as to extend in registry with the Y-shaped channel 19 to guidingly receive the ridge portions 21, 21 of the top stop members T, T when the slider 15 has been brought up into engagement therewith.

Figure 4:
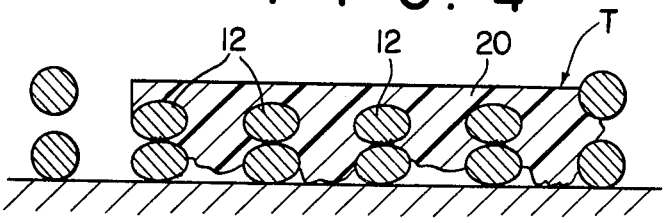
FIG. 4 is an enlarged longitudinal sectional view of the stringer of FIG. 2 as taken along the plane of line IV—IV in FIG. 2.
Figure 5:
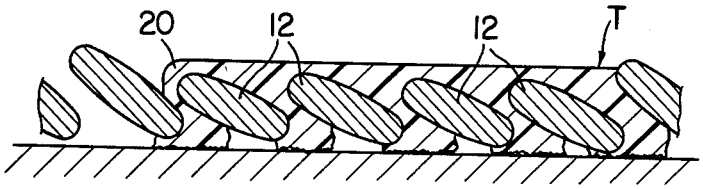
FIG. 5 is similar to FIG. 4 but as taken along the plane of line V—V in FIG. 2.
Figure 8:
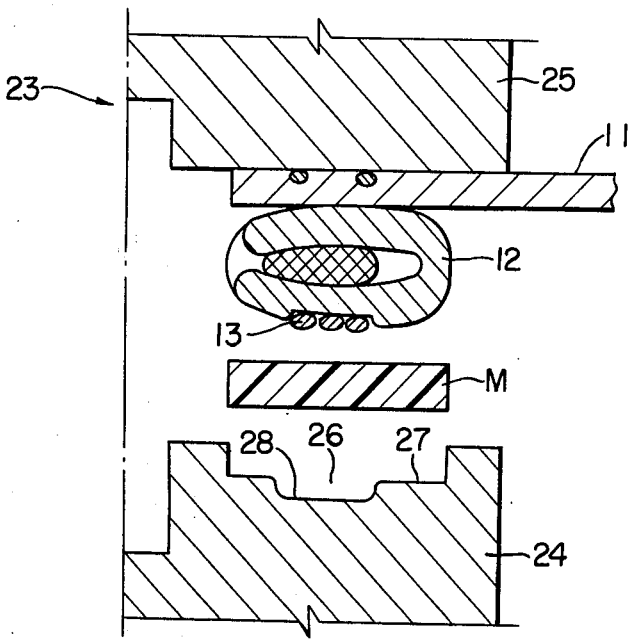
FIG. 8 is a fragmentary cross-sectional view of an apparatus for molding synthetic-resinous strips into the top stop members on the slide fastener of FIG. 1.

An apparatus 23 for molding the top stop members T, T of the construction as described on the slide fastener—exactly, only one of the two identical parts of the apparatus for molding one of the top stop members on one stringer is presented for clarity's sake—is shown in FIG. 8. The apparatus part generally comprises a horn tip 25 stationarily mounted on a suitable ultrasonic vibration mechanism (not shown) and an anvil member 24 mounted on a suitable base frame (not shown) in vertically opposed relation with the horn tip 25 and adapted to be vertically movable towards and away from the same. The anvil member 24 has a cavity 26 which includes a first section 27 corresponding in shape and size to the platelike body 20 of the resultant top stop member T and a second section 28 corresponding in shape and size to the elongated ridge portion 21. In molding operation, one of the stringers (generally slide fastener halves) of the slide fastener F and a rectangular strip of a synthetic-resinous material M are brought into between the anvil member 24 and the horn tip 25 in such a way that the row of fastener elements 12 mounted on the stringer and the synthetic-resinous strip M are disposed in registry with the first section 27 of the cavity 26 while the sewn stitches 13 binding the fastener elements 12 to the tape 11 are disposed in registry with the second section 28 of the cavity 26. Thereafter, the anvil member 24 ascends to an operative position in which the same presses the stringer and the synthetic-resinous strip M against the ultraonic horn tip 25, whereupon ultrasonic energy is given off to cause the synthetic-resinous strip M to melt. Some of the molten material M flows into the cavity 26 in the anvil member 24 thus to form the top stop member T of the construction specified earlier, and other deep into interstices between each adjacent fastener elements 12 to help retain the resultant top stop member T on the fastener element 12, as is better shown in FIGS. 4 and 5.

Figure 9:
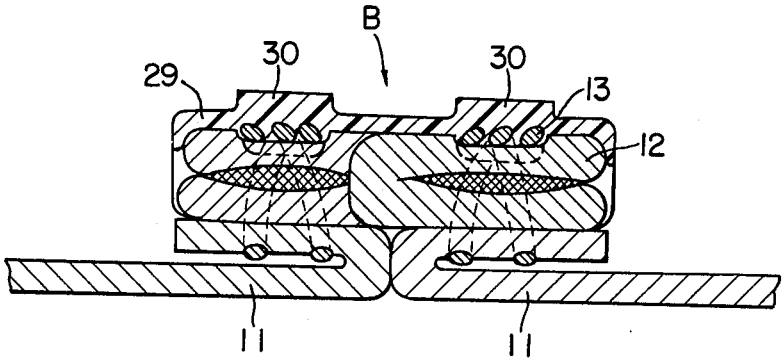
FIG. 9 is a cross-sectional view of the concealed type of slide fastener, now showing a bottom stop embodying this inventive concept instead of a top stop.

Although a top stop has been so far discussed by way of a preferred embodiment of this inventive concept, it may be embodied in a bottom stop B as well, as shown in FIG. 9. The bottom stop B comprises a platelike body 29 molded on and longitudinally of several lowermost interlocked fastener elements 12, 12 of both the interengaged rows of fastener elements and two opposed ridge portions 30, 30 provided on the platelike body 29 so as to extend throughout the full length thereof. The platelike body 29 extends over the entire width of the double rows of fastener elements 12, 12, while the ridge portions 30, 30 extend on and along those linear regions of the platelike body 29 which register with the respective lines of sewn stitches 13, 13.

With the construction of the end stops T, B, whether top or bottom, as hereinbefore mentioned, the linear region of the synthetic-resinous strip M positioned in registry with the line of sewn stitches 13 is subjected to less pressures by the anvil member 24 during the molding operation since the material M in the region is permitted to escape into the second section 28 of the cavity 26 in the anvil member 24, and hence the lines of sewn stitches 13, 13 is likewise subjected to less ultrasonic energy by the ultrasonic horn 25. This means that the lines of sewn stitches 13, 13 are well prevented from being rendered feeble, which assures reliable retention of the fastener elements 12, 12 on the carrier tapes 11, 11. Further advantageously, the synthetic-resinous material of the stip M on the region other than the linear region is forced to flow through the interstices between each adjacent fastener elements 12, 12 into the surface of the carrier tape 11, 11 during the molding operation, which assures reliable retention of the resultant end stop T, B on the row of fastener elements 12, 12. Since the end stop T, B is stably retained on the fastener elements 12, 12 which are in turn stably retained on the carrier tapes 11, 11, it enjoys reliable function as such for a prolonged period of time. Additionally, since the elongated ridge portions 21, 30, 30 come into slidable engagement with the Y-shaped guide groove 22 formed on the slider 15 when the slider 15 is brought into engagement with the end stop T, B and being locked thereby, the end stop T, B is well prevented against lateral displacement, thus helping close both the stringers of the slide fastener F more closely or tightly with very little looseness.

Although the invention has been described with a certain degree of particularity, it is understood that the present disclosure has been made only by way of example and that numerous changes in the details of construction and the combination and arrangement of parts may be resorted to without departing from the scope of the invention as hereinafter claimed.

What is claimed is:

1. A slide fastener comprising:

(a) a pair of carrier tapes;

(b) two rows of continuous interlocking fastener elements made of a synthetic-resinous material and secured by lines of sewn stitches to inner edges of said respective tapes;

(c) a slider including a slider body, a pair of side flanges provided on the opposite side edges thereof and a neck portion provided on the flared front end of said slider body to define with said slider body and said side flanges a Y-shaped channel to slidably receive said interlocking fastener elements for opening and closing thereof; and (d) a top stop made of a synthetic-resinous material and comprising a platelike body substantially rectangular in plan molded on and longitudinally of a plurality of uppermost fastener elements of one of said rows of fastener elements so as to extend over the substantially entire width of said one row of fastener elements and an elongated ridge portion provided on and longitudinally of said platelike body so as to extend along its linear region registering with one of said lines of sewn stitches.

2. A slide fastener recited in claim 1, wherein said slider body is provided at its surface partly defining said Y-shaped channel with a groove adapted for slidable engagement with said ridge portion.

3. A slide fastener comprising:

(a) a pair of carrier tapes;

(b) two rows of continuous interlocking fastener elements made of a synthetic-resinous material secured by lines of sewn stitches to inner edges of said respective tapes;

(c) a slider including a slider body, a pair of side flanges provided on the opposite side edges thereof and a neck portion provided on the flared front end of said slider body to define with said slider body and said side flanges a Y-shaped channel to slidably receive said interlocking fastener elements for opening and closing thereof; and (d) a bottom stop made of a synthetic-resinous material and comprising a platelike body substantially rectangular in plan molded on and longitudinally of a plurality of lowermost interlocked fastener elements of said two rows of fastener elements so as to extend over the substantially entire width of said two interlocked rows of fastener elements and two ridge portions provided on and longitudinally of said platelike body so as to extend along its linear regions registering with the respective lines of sewn stiches.

4. A slide fastener recited in claim 3, wherein said slider body is provided at its surface partly defining said Y-shaped channel with a groove adapted for slidable engagement with said ridge portions.

* * * * *